US007004004B2

(12) United States Patent
Arns et al.

(10) Patent No.: US 7,004,004 B2
(45) Date of Patent: Feb. 28, 2006

(54) METHOD OF MAKING A HARDENED MOTOR-VEHICLE PART OF COMPLEX SHAPE

(75) Inventors: Wilhelm Arns, Paderborn (DE); Hans-Jürgen Knaup, Bad Lippspringe (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 10/782,128

(22) Filed: Feb. 19, 2004

(65) Prior Publication Data

US 2004/0163439 A1 Aug. 26, 2004

(30) Foreign Application Priority Data

Feb. 20, 2003 (GB) ..... 103 07 184

(51) Int. Cl.
*B21D 37/16* (2006.01)

(52) U.S. Cl. ..... 72/342.1; 72/38; 72/47; 72/364; 72/342.94; 148/648

(58) Field of Classification Search ..... 72/38, 72/47, 348, 364, 379.2, 342.1, 342.7, 342.8, 72/342.92, 342.94; 148/609, 643, 647, 648, 148/653

See application file for complete search history.

(56) References Cited

U.S. PATENT DOCUMENTS

| | | | | |
|---|---|---|---|---|
| 5,419,791 | A * | 5/1995 | Folmer | 148/585 |
| 6,003,359 | A * | 12/1999 | Futamura et al. | 72/404 |
| 6,230,539 | B1 * | 5/2001 | Dickson et al. | 72/364 |
| 6,296,805 | B1 | 10/2001 | Laurent | |
| 6,457,342 | B1 * | 10/2002 | Tanahashi et al. | 72/364 |
| 6,550,302 | B1 * | 4/2003 | Ghosh | 72/342.8 |
| 6,613,164 | B1 * | 9/2003 | Dykstra et al. | 148/520 |

FOREIGN PATENT DOCUMENTS

| | | |
|---|---|---|
| DE | 24 52 486 | 5/1975 |
| EP | 1 013 785 | 6/2000 |

* cited by examiner

*Primary Examiner*—Ed Tolan
(74) *Attorney, Agent, or Firm*—Herbert Dubno; Andrew Wilford

(57) ABSTRACT

A hardened steel part of complex shape is made from a workpiece by first heating the workpiece to an annealing temperature. Then, while the workpiece is still at the annealing temperature, the workpiece is rapidly deformed by a machine into an intermediate shape. The deformed workpiece is then moved from the machine to a press, and, while the workpiece is still at the annealing temperature, it is deformed in the press to the complex shape and then held in the press to harden the workpiece.

9 Claims, 1 Drawing Sheet

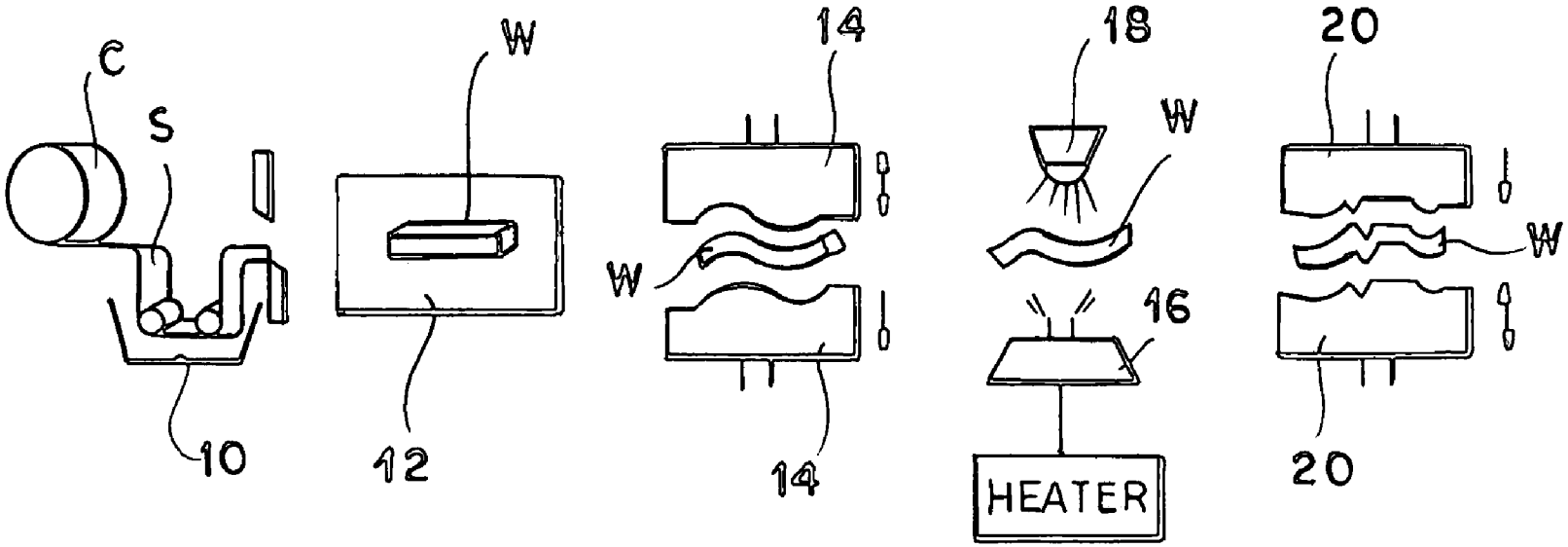
C
S
10
W
12
14
W
14
18
W
16
HEATER
20
W
20

METHOD OF MAKING A HARDENED MOTOR-VEHICLE PART OF COMPLEX SHAPE

FIELD OF THE INVENTION

The present invention relates to a hardened part of complex shape. More particularly this invention concerns the manufacture of such a part used in a motor vehicle.

BACKGROUND OF THE INVENTION

In order to make a shaped part of sheet metal, for instance for use in a motor vehicle, it is known from German 24 52 486 of C. Ridderstrale to heat the sheet to above the $AC_3$ annealing temperature and then to deform it in less than 5 sec in a machine between a pair of cooled tools. The workpiece is held after deformation between the tools to quench-harden it. This method only works well for steel parts with a strong grain structure and good dimensional stability.

More complexly shaped parts cannot be done in a single deforming step. Thus the workpiece is moved from a preworking machine, a forging press for instance, where it gets an intermediate shape, to a final press where it is given its final shape and hardened. The preworking takes place on a workpiece that is well below annealing temperatures as a sheet-metal workpiece has only limited capacity to hold heat. Thus the preformed workpiece must be reheated before being pressed into its final shape.

Parts used in motor vehicles must have, in addition to a shape of exactly defined dimensions and the necessary hardened grain structure, some form of corrosion protection. Thus EP 1,013,785 of J. Laurent proposes coating a hot-rolled workpiece with an appropriate protective metal or alloy before the preworking step. Subsequent deformation at high temperature as described above produces an intermetallic phase between the protective coating and the underlying steel so as to prevent decarbonization. The hardening process also improves the surface hardness of the protective metal coating. When the protective metal is aluminum or an aluminum alloy, it can easily withstand annealing temperatures. Such a coating, however, becomes brittle and can separate or spall off when worked cold.

It is therefore recommended to reheat such coated workpieces. Thus it is necessary to reheat the workpiece after the preworking step. It is well known (see "Umformtechnik" Springer Verlag 1988, volume 2, chapter 3.4.2.4) to use the heat generated in a forging operation for hardening. This works with relatively massive workpieces capable of holding heat, but not with thin sheet-metal workpieces.

OBJECTS OF THE INVENTION

It is therefore an object of the present invention to provide an improved method of making and heat-treating a complexly shaped part.

Another object is the provision of such an improved method of making and heat-treating a complexly shaped part which overcomes the above-given disadvantages, that is which allows such a part to be made in a low-cost mass-production operation.

SUMMARY OF THE INVENTION

A hardened steel part of complex shape is made from a workpiece by first heating the workpiece to an annealing temperature. Then, while the workpiece is still at the annealing temperature, the workpiece is rapidly deformed by a machine into an intermediate shape. The deformed workpiece is then moved from the machine to a press, and, while the workpiece is still at the annealing temperature, it is deformed in the press to the complex shape and then held in the press to harden the workpiece.

With the method of this invention, therefore, the workpiece is heated once, normally in a furnace or inductively, before it is preformed into the intermediate shape. Then, while maintaining the annealing temperature, it is moved to a press where it is deformed into its final shape and held in the press to harden.

This method works extremely well when the workpiece is plated with a corrosion-protecting metal or metal alloy before the initial heating step. Sheet metal is ideally coated with aluminum or an aluminum alloy, as aluminum protects against decarbonization and oxidation during the entire heating, preworking, and final working steps, while protecting the finished part against corrosion. The standard dip-coating creates an intermetallic phase between the underlying steel and the aluminum coating so that during the subsequent hot deformation the coating remains in place, that is it will not separate as is likely during cold working. Using such a plated sheet-metal workpiece eliminates the need for a subsequent cleaning and coating. Intermediate heating steps are eliminated so that the finished part can be produced very inexpensively.

In accordance with the invention cooling of the workpiece during the preworking step is accomplished by minimizing contact between a deforming tool of the preworking machine and the workpiece to reduce cooling of the workpiece. Alternatively it is possible to retain the annealing temperature in the workpiece by heating the parts or tools of the preworking machine that engage the workpiece.

Heat loss during transport from the preworking machine to the final-working press is prevented in part by simply moving the workpiece very quickly along the shortest possible path. A sheet-metal workpiece with limited mass can be heated during such travel, typically by irradiating it or by blowing hot gas on it. Surrounding the travel path with heat-reflecting mirrors further reduces heat loss.

Under any circumstances, both the preworking and final-working steps and well as the heating and moving steps are carried out under an atmosphere of inert oxygen-free gas.

BRIEF DESCRIPTION OF THE DRAWING

The above and other objects, features, and advantages will become more readily apparent from the following description, reference being made to the accompanying drawing whose sole FIGURE is a largely schematic diagram illustrating the method of this invention.

SPECIFIC DESCRIPTION

As seen in the drawing a strip S is drawn from a coil C and passed through a plating bath 10 then cut by blades 12 into a flat plate workpiece W that is heated in an oven to an annealing temperature above $AC_3$. The workpiece W is then, without losing any substantial heat, deformed by a preworking press 14 into an intermediate shape.

The preworked workpiece W is then moved past a heating blower 16 and underneath a radiant-heat source 18 to a press 20 where it is given its final shape. The coating applied at the bath 10 is not damaged by the preworking in the machine 12 or in the final press 20.

We claim:

1. A method of making a hardened steel part of complex shape from a workpiece, the method comprising the step of sequentially:

a) heating the workpiece to an annealing temperature;

b) while the workpiece is still at the annealing temperature, rapidly deforming the workpiece with a machine into an intermediate shape;

c) moving the deformed workpiece from the machine to a press while maintaining it at the annealing temperature; and d) while the workpiece is still at the annealing temperature, deforming the workpiece in the press to the complex shape and then holding the workpiece in the press until the temperature of the workpiece drops below the annealing temperature to harden the workpiece.

2. The method defined in claim 1, comprising the step of minimizing contact in step b) between a deforming tool and the workpiece to reduce cooling of the workpiece.

3. The method defined in claim 1 wherein in step b) the workpiece is deformed by engagement with a heated tool of the machine.

4. The method defined in claim 1, further comprising the step of b') heating the workpiece during step c).

5. The method defined in claim 1 wherein the workpiece is heated in step b') by blowing hot gas on it.

6. The method defined in claim 1 wherein the workpiece is heated in step b') by radiating heat on it.

7. The method defined in claim 1, further comprising the step of surrounding the workpiece during steps a) through d) with an atmosphere of inert gas.

8. The method defined in claim 1, further comprising before step a), the step of applying a coating of a protective metal to the workpiece.

9. The method defined in claim 1 wherein the annealing temperature is the $AC_3$ temperature of steel.

* * * * *